US006823606B2

(12) United States Patent
Rollenitz et al.

(10) Patent No.: US 6,823,606 B2
(45) Date of Patent: Nov. 30, 2004

(54) DRYER SECTION

(75) Inventors: Erich Rollenitz, St. Pölten (DE); Bernhard Schleidt, Vienna (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/418,628

(22) Filed: Apr. 18, 2003

(65) Prior Publication Data

US 2003/0196345 A1 Oct. 23, 2003

(30) Foreign Application Priority Data

Apr. 19, 2002 (DE) ..... 102 17 571

(51) Int. Cl.[7] ..... F26B 11/02

(52) U.S. Cl. ..... 34/117; 34/129; 34/635; 34/636

(58) Field of Search ..... 34/114, 117, 120, 34/129, 623, 635, 636, 640, 659

(56) References Cited

U.S. PATENT DOCUMENTS

| | | | | |
|---|---|---|---|---|
| 4,359,828 A | * | 11/1982 | Thomas | 34/114 |
| 5,232,554 A | | 8/1993 | Kotitschke | 162/193 |
| 5,579,589 A | * | 12/1996 | Oechsle et al. | 34/446 |
| 5,600,897 A | | 2/1997 | Sollinger et al. | 34/115 |
| 5,628,124 A | | 5/1997 | Skaugen et al. | 34/117 |
| 5,673,495 A | | 10/1997 | Jilek et al. | 34/458 |
| 5,735,060 A | * | 4/1998 | Atzinger et al. | 34/117 |
| 5,737,848 A | * | 4/1998 | Chau-Huu et al. | 34/114 |
| 6,442,865 B1 | * | 9/2002 | Wolf et al. | 34/114 |

FOREIGN PATENT DOCUMENTS

| | | | |
|---|---|---|---|
| DE | 041 19 068 | 6/1991 | D21F/5/04 |
| DE | 196 37 529 | 9/1996 | D21F/5/00 |
| DE | 197 13 645 | 4/1997 | B65H/20/10 |
| EP | 0 635 515 | 5/1995 | D21F/5/04 |

* cited by examiner

*Primary Examiner*—Ira S. Lazarus
*Assistant Examiner*—Kathryn S. O'Malley
(74) *Attorney, Agent, or Firm*—Taylor & Aust, P.C.

(57) ABSTRACT

A dryer section for drying a moving material web, specifically a paper or cardboard web, including several dryer groups that are located successively in the direction of web travel, whereby at least one of these is a double row configuration and whereby the material web is continuously supported in at least one transitional zone from a single row dryer group to an immediately following double row dryer group and/or in a transitional zone between two double row dryer groups that are located immediately following each other.

13 Claims, 3 Drawing Sheets

DRYER SECTION

BACKGROUND OF THE INVENTION

1. Field of the Invention

The present invention relates to a dryer section for drying a moving material web, specifically a paper or cardboard web, including several dryer groups that are located one after the other in the direction of web travel.

2. Description of the Related Art

Dryer sections of this type are described, for example in publications U.S. Pat. No. 5,539,999, WO 98/48106 and U.S. Pat. No. 5,673,495.

SUMMARY OF THE INVENTION

The present invention provides an improved dryer section including several consecutive dryer groups. Special consideration is given to further optimization of the design of the group separation in the dryer section.

The present invention includes a dryer section for drying a moving material web, specifically a paper or cardboard web, with several dryer groups that are located successively in the direction of web travel. At least one of these is a double row configuration, whereby the material web is continuously supported in at least one transitional zone from a single row dryer group to an immediately following double row dryer group and/or in a transitional zone between two double row dryer groups that are located immediately following each other.

Due to this embodiment, optimum concept geometry for the dryer section results that, among other things, represents savings in the number of rolls and cylinders, including doctors. In addition the overall length of the dryer section can be reduced based on this optimized concept. Improved broke removal is achieved with a rope-free transfer concept. This design concept according to the present invention also permits the installation of auxiliary components, i.e. nozzle devices and/or similar components. In addition, the solution in accordance with the present invention also permits the installation of, for example, web knock-off devices. The result is an optimum arrangement of group separation in the dryer section, and especially an optimization of a respective transition from a single row to a double row, or between two double row dryer sections. In contrast to the hitherto conventional dryer sections, the fiber web is always supported between the dryer sections.

In a preferred practical embodiment of the dryer section in accordance with the present invention, the material web is transferred in a respective transition zone directly from the drying cylinder of the preceding dryer group by a dryer fabric that is allocated to a succeeding double row dryer group. It is preferred that the material web is received by an upper dryer fabric of the following double row dryer group. The preceding dryer group can again specifically be a single row or a double row dryer group.

The material web can be continuously supported in all transition zones that are provided between two respective dryer groups. In addition, the material or fiber web can, for example, also be continuously supported in a respective transition zone between two single row dryer groups.

It is also advantageous if a suction box is provided for supporting the web transfer in any respective transition zone. In a preferred configuration, the material web travels around a suction roll in a respective transition zone that can, for example, be a suction felt roll and/or a dryer fabric roll.

The material web can specifically travel around the suction roll, together with the upper dryer fabric of the following double row dryer group. One of the advantages in doing this is the increased operational safety during threading of the fiber web since, after the transfer to the relating dryer fabric the web can simply be run into the basement, in the event that any problems should arise. This is particularly important at high speeds. The transfer strip can come loose from the dryer fabric. Should this occur, paper shreds fall into the machine basement during this downward directed transfer of the transfer strip from the preceding drying cylinder, where they can no longer interfere with the production process. The paper shreds cannot get into the area above the drying cylinders (dryer felt or dryer fabric run), and cannot therefore, disturb the production process.

A respective suction box and/or a respective suction roll can be provided in a transition zone between any dryer groups, for example even between single row dryer groups.

In an especially cost effective and preferred arrangement, the vacuum in the suction roll is produced via the suction box. This eliminates the expense of having to run the line through the bearing of the suction roll. The shell of the suction roll should be grooved and/or drilled in order to distribute the suction effect across the shell surface that is in contact with the web. It is also possible to connect the suction box with a vacuum source through the interior of the suction roll.

Of particular advantage is the combination of a downward directed web transfer from the drying cylinder of the preceding dryer group by way of the dryer fabric of the following dryer group, a suction roll in the area of the lower rerouting of the dryer fabric, and a suction box for stabilization of the web run between the dryer cylinders and the suction roll.

Particularly advantageous are the transfer edge zones in the suction roll and the suction box in the area where the transfer strip travels during the transfer process. The transfer zones can, for example, be provided on the edge on the operator side of the machine. The transfer zones can be supplied with vacuum, independently of the other zones. This method permits transfer without ropes, thereby simplifying the transfer process as well as improving its safety.

BRIEF DESCRIPTION OF THE DRAWINGS

The above-mentioned and other features d advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
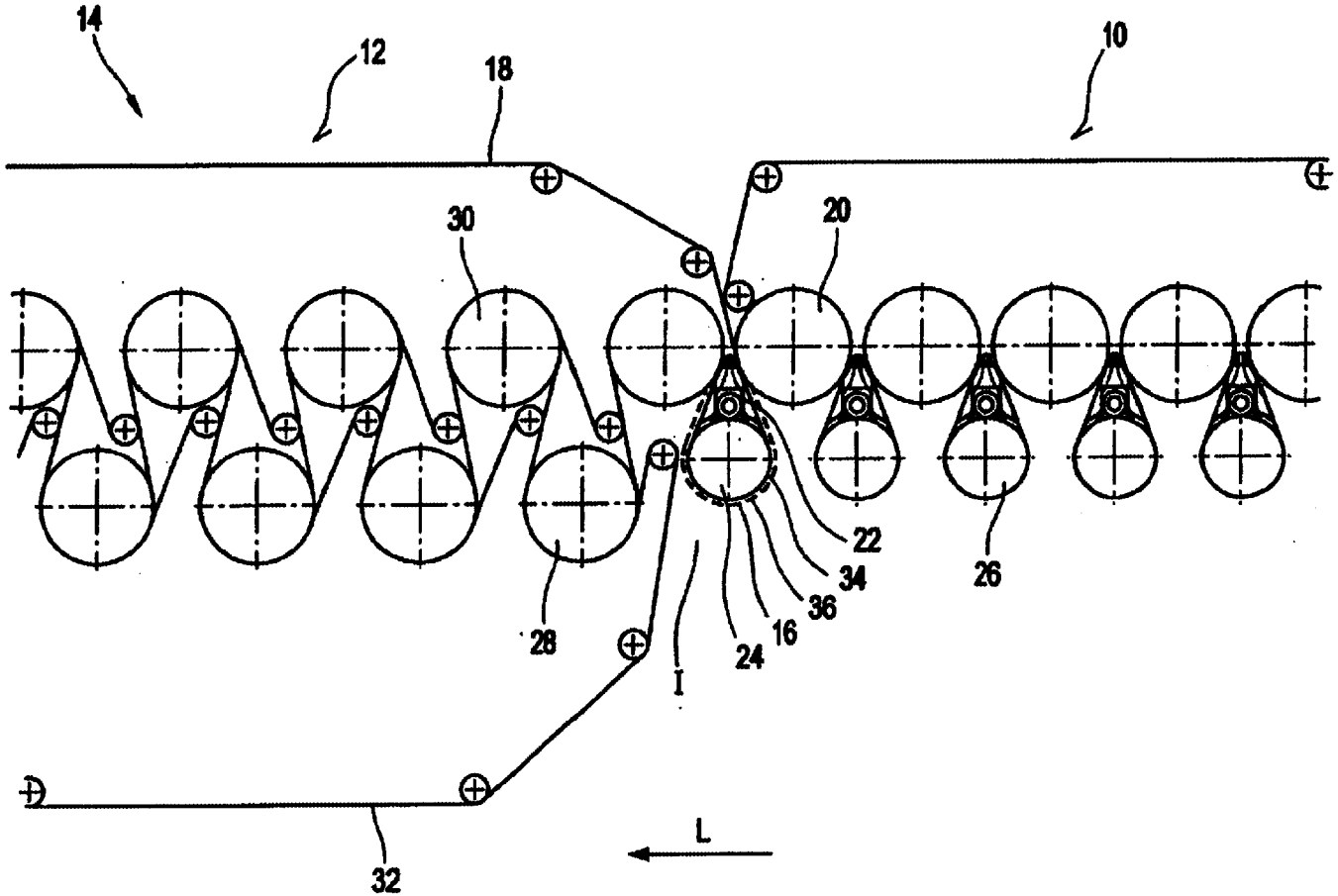
FIG. 1 is a schematic side view of a embodiments of the preset invention illustrating a transition zone from a single row dryer group to a successive double row dryer group of a dryer section.

Referring now to the drawings, and more particularly to FIG. 1, there is shown a transition zone 1 from a single row dryer group 10 to an immediately following double row dryer group 12 in a dryer section 14, for drying of a moving material or fiber web that can specifically be a paper or cardboard web. Dryer section 14 can accordingly specifically be part of a paper machine. Dryer section 14 consequently includes several dryer groups 10, 12 that are located one after another in direction of web or machine travel L, whereby in the current example at least one is a double row arrangement.

Material web 16 is continuously supported in the transition zone I from the single row dryer group 10 to the following double row dryer group 12.

Material web 16 is transferred in transition zone I, directly from the last drying cylinder 20 of the preceding single row dryer group 10 to an upper dryer fabric 18 that is allocated to following double row dryer group 12. Suction box 22 is preferably provided, in order to support the web transfer in transition zone I. In this transition zone material web 16 is additionally routed together with upper dryer fabric 18 of the following double row dryer group 12 preferably around suction roll 24 that can, for example, be a suction felt roll and/or a dryer fabric suction roll.

Material web 16 is run alternately over drying cylinders 20 and web guide rollers 26 in single row dryer group 10. In contrast, in double row dryer group 12, material web 16 is run alternately over drying cylinders 28 of a lower row of cylinders and drying cylinders 30 of an upper row of cylinders. In addition to upper dryer fabric 18 for the upper cylinder row, a lower dryer fabric 32 for the lower cylinder row of the double row dryer group 12 is provided.

Figure 2:
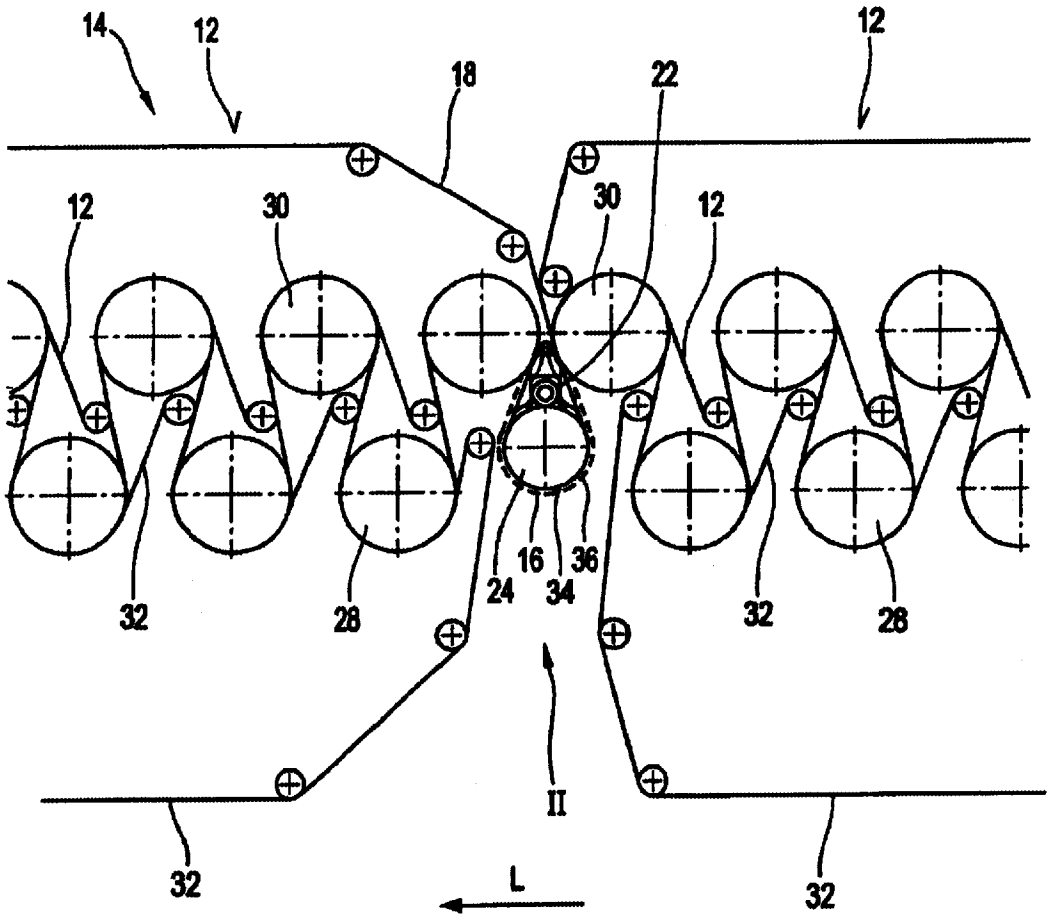
FIG. 2 is a schematic side view of an embodiment of the present invention illustrating a transition zone between two double row dryer groups of the dryer section.

FIG. 2 illustrates a transition zone II between two double row dryer groups 12 of dryer section 14 that are located immediately following each other. Material web 16 is continuously supported in the transition zone II. Material web 16 is transferred in transition zone II directly from the last drying cylinder 30 of the preceding double row dryer group 12 to upper dryer fabric 18 that is allocated to the following double row dryer group 12.

Suction box 22 is preferably again provided, in order to support the web transfer in transition zone II. In addition, material web 16, together with upper dryer fabric 18 of the following double row dryer group 12, is again routed preferably around suction roll 24, for example a suction felt roll and/or a dryer fabric suction roll.

In the two double row dryer groups 12 material web 16 is run alternately over drying cylinders 28 of a lower cylinder row and drying cylinders 30 of an upper cylinder row. In each of the two double row dryer groups 12 an upper dryer fabric 18 is again assigned to the upper cylinder row, and lower dryer fabric 32 is allocated to the lower cylinder row. The direction of web or machine travel is again indicated by an arrow "L" in FIG. 2.

For functional purposes, material web 16 can always be continuously supported in all transition zones that are located respectively between two dryer groups 10, 12. Therefore, material web 16 can also be continuously supported between single row dryer groups. In this instance too, a suction box and/or a suction felt roll may specifically be provided between the relevant groups.

Figure 3:
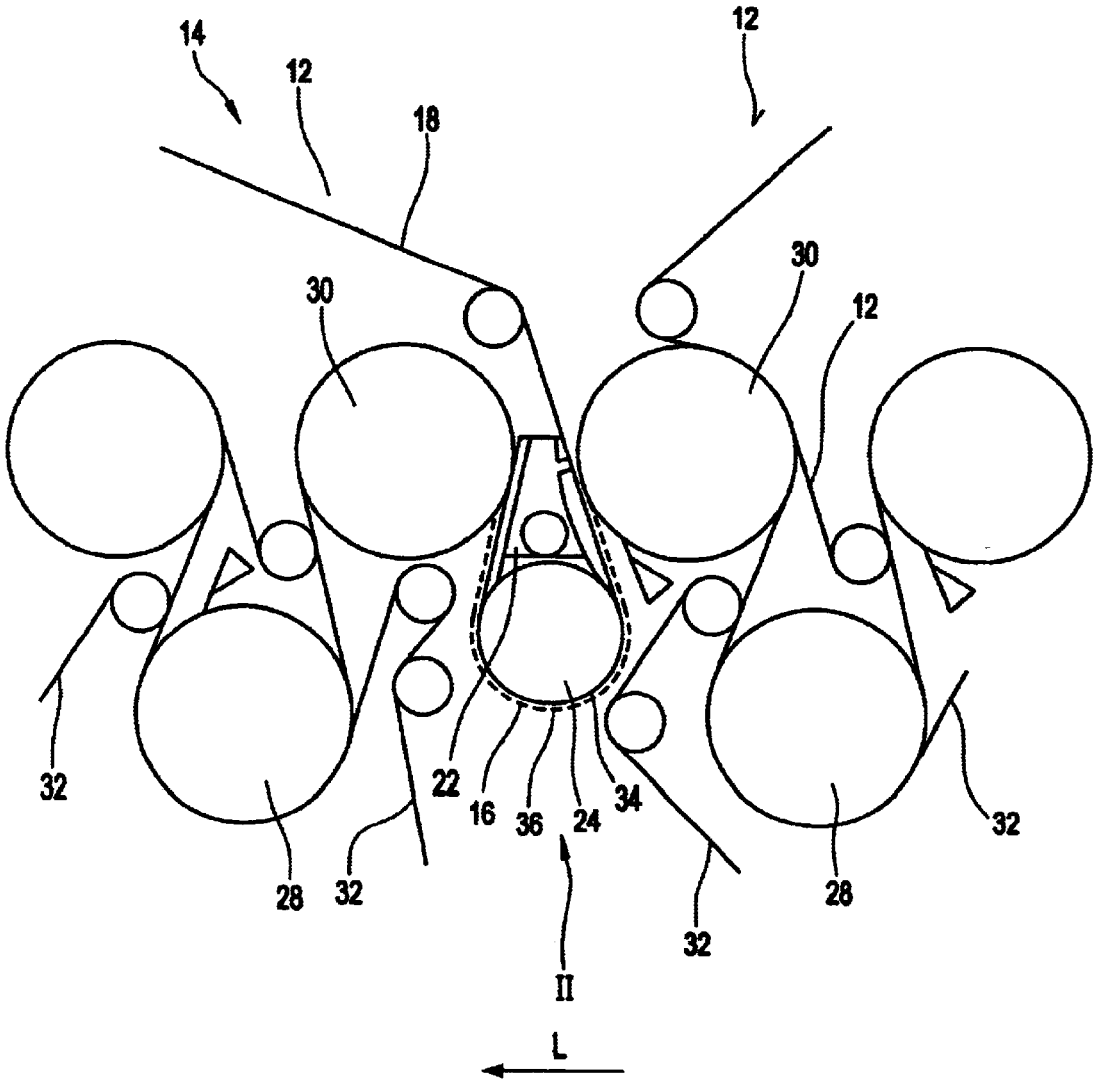
FIG. 3 is a schematic side view of an embodiment of the present invention illustrating a transition zone between, for example, two double row dryer groups where a suction box is provided to support the web transfer.

FIG. 3 again shows a detailed illustration of the transition section II between two double row dryer groups 12 (see also FIG. 2). Suction box 22 that is provided to support the web transfer is again clearly visible in the transition zone II. Material web 16, together with upper dryer fabric 18 of following double row dryer group 12 can again be run preferably around suction roll 24 that can, for example again be a suction felt roll and/or a dryer fabric suction roll. For the remainder, transition zone II of FIG. 3 corresponds, at least essentially, with the transition zone illustrated in FIG. 2. Corresponding components have been allocated identical reference designations.

As already mentioned, such a suction box 22 and/or such a suction roll 24 can also be provided in a respective transition zone I from a single row dryer group 10 to a immediately following double row dryer group 12 (compare FIG. 1) and/or, for example, in a respective transition zone between two single zone dryer groups. The vacuum in the respective suction roll 24 can be produced especially through suction box 22.

A particular advantage of the present invention is that in combination with a downward directed web transfer from drying cylinder 20, 30 of the preceding dryer group 10, 12, suction roll 24 in the area of the lower rerouting of dryer fabric 18 as well as suction box 22 for stabiliztion of the web run between drying cylinders 20, 30 or 3,30,30 and suction roll 24 are provided.

Transfer edge zones 34 can be provided in suction roll 24 and suction box 22 in an area in which a transfer strip 36 runs during a transfer process. Transfer edge zones 34 can be provided on an operator side machine edge. Transfer edge zones 34 can be supplied with a vacuum independently of other zones (not shown).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dryer section for drying a moving fiber material web, comprising:

at least one preceding dryer group, each said preceding dryer group including one of a single row dryer group and a double row dryer group;

at least one succeeding double row dryer group, each said succeeding double row dryer group located successively in a direction of web travel respective to a corresponding said preceding dryer group; and at least one transitional zone, each said transitional zone having a mechanical backing support for continuously supporting the material web from a corresponding said preceding dryer group to a said succeeding double row dryer group.

2. The dryer section of claim 1, further including a last drying cylinder in said direction of web travel in one of said preceding single row dryer group and said preceding double row dryer group, a dryer fabric allocated to said succeeding double row dryer group, the material web being transferred from said last drying cylinder by said drying fabric.

3. The dryer section of claim 2, further including an upper dryer fabric of said succeeding double row dryer group, the material web being taken over by said upper dryer fabric.

4. The dryer section of claim 1, wherein the material web is always continuously supported in all said transition zones that are provided between each said preceding dryer group and each succeeding double row dryer group.

5. A dryer section for drying a moving fiber material web, comprising:

at least one preceding dryer group, each said preceding dryer group including one of a single row dryer group and a double row dryer group;

at least one succeeding double row dryer group, each said succeeding double row dryer group located successively in a direction of web travel respective to a corresponding said preceding dryer group;

at least one transitional zone, each said transitional zone continuously supporting the material web from a corresponding said preceding dryer group to a said succeeding double row dryer group; and a suction box in said transitional zone, said suction box supporting a transfer of the web in said transitional zone.

6. The dryer section of claim 5, further including a suction roll in said transitional zone, the material traveling around said suction roll.

7. The dryer section of claim 6, wherein said suction roll is one of a suction felt roll and a dryer fabric roll.

8. The dryer section of claim 6, further including an upper dryer fabric associated with a corresponding said succeeding double row dryer group, the material web traveling around said suction roll with said upper dryer fabric.

9. The dryer section of claim 6, further including a vacuum in said suction roll produced via said suction box.

10. The dryer section of claim 8, wherein said preceding dryer group further includes a preceding drying cylinder, said suction box is located between said preceding drying cylinder and said suction roll, and said preceding drying cylinder, said suction box and said suction roll provides a stabilization of a web run in combination with a downward directed web transfer from said preceding drying cylinder.

11. The dryer section of claim 6, further including a plurality of transfer edge zones in both said suction roll and said suction box in an area in which a transfer strip runs during a transfer process.

12. The dryer section of claim 11, wherein said transfer edge zones are on an operator side machine edge.

13. The dryer section of claim 11, wherein said transfer edge zones are supplied with a vacuum independently of other zones.

* * * * *

UNITED STATES PATENT AND TRADEMARK OFFICE

CERTIFICATE OF CORRECTION

PATENT NO. : 6,823,606 B2
DATED : November 30, 2004
INVENTOR(S) : Rollenitz et al.

It is certified that error appears in the above-identified patent and that said Letters Patent is hereby corrected as shown below:

Column 2,
Line 44, please delete “d” and substitute therefore -- and --.

Column 3,
Line 10, after “machine.”, begin a new paragraph with “Dryer”.

Column 4,
Line 24, please delete “3,30,30” and substitute therefore -- 30,30 --.

Signed and Sealed this

Twenty-fourth Day of May, 2005

JON W. DUDAS
*Director of the United States Patent and Trademark Office*